US006315114B1

(12) United States Patent
Keck et al.

(10) Patent No.: US 6,315,114 B1
(45) Date of Patent: Nov. 13, 2001

(54) DURABLE HIGH FLUID RELEASE WIPERS

(75) Inventors: Laura Elizabeth Keck, Alpharetta, GA (US); Nicole Michele Amsler, Larkspur, CO (US); Andrew Edward Diamond, Great Barrington, MA (US); James J. Holley, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/531,300

(22) Filed: Mar. 22, 2000

Related U.S. Application Data

(60) Provisional application No. 60/125,808, filed on Mar. 23, 1999.

(51) Int. Cl.[7] ..... B65D 81/24

(52) U.S. Cl. ..... 206/210; 206/494; 428/36.1

(58) Field of Search ..... 206/210, 449, 206/494; 428/36.1

(56) References Cited

U.S. PATENT DOCUMENTS

| | | |
|---|---|---|
| 4,171,047 | 10/1979 | Doyle et al. . |
| 4,328,279 | 5/1982 | Meitner et al. . |
| 4,333,979 | 6/1982 | Sciaraffa et al. . |
| 4,436,780 | 3/1984 | Hotchkiss et al. . |
| 4,659,609 | 4/1987 | Lamers et al. . |
| 4,741,944 | 5/1988 | Jackson et al. . |
| 4,775,582 | 10/1988 | Abba et al. . |
| 4,833,003 | 5/1989 | Win et al. . |
| 4,853,281 | 8/1989 | Win et al. . |
| 4,906,513 | 3/1990 | Kebbell et al. . |
| 5,244,482 | 9/1993 | Hassenboehler, Jr. et al. . |
| 5,284,703 | 2/1994 | Everhart et al. . |
| 5,441,550 | 8/1995 | Hassenboehler, Jr. et al. . |
| 5,575,874 | 11/1996 | Griesbach, III et al. . |
| 5,595,786 | 1/1997 | McBride, Jr. et al. . |
| 5,599,366 | 2/1997 | Hassenboehler, Jr. et al. . |
| 5,605,749 | 2/1997 | Pike et al. . |
| 5,643,653 | 7/1997 | Griesbach, III et al. . |
| 5,656,361 | 8/1997 | Vogt et al. . |
| 5,681,646 | 10/1997 | Ofosu et al. . |
| 5,759,926 | 6/1998 | Pike et al. . |
| 5,858,504 | 1/1999 | Fitting . |
| 5,874,160 | 2/1999 | Keck . |
| 5,885,909 | 3/1999 | Rudisill et al. . |
| 5,895,710 | 4/1999 | Sasse et al. . |
| 5,910,455 | 6/1999 | Maddern et al. . |
| 5,962,112 | 10/1999 | Haynes et al. . |
| 6,001,187 | 12/1999 | Paley et al. . |
| 6,028,018 | 2/2000 | Amundson et al. . |
| 6,103,061 | 8/2000 | Anderson et al. . |
| 6,177,370 | 1/2001 | Skoog et al. . |

FOREIGN PATENT DOCUMENTS

| | | |
|---|---|---|
| 0 068 722 B1 | 4/1988 | (EP) . |
| 96/41041 | 12/1996 | (WO) . |
| 97/35055 | 9/1997 | (WO) . |
| 98/03147 | 1/1998 | (WO) . |
| 98/03713 | 1/1998 | (WO) . |
| 98/23804 | 6/1998 | (WO) . |

*Primary Examiner*—Shian Luong
(74) *Attorney, Agent, or Firm*—Douglas H. Tulley, Jr.

(57) ABSTRACT

A cleaning system is provided comprising a sealable container housing a saturated stack of durable fine spunbond fiber cleaning sheets; the cleaning sheets have an average fiber diameter less than 18 micrometers, a tensile strength of at least 140-g/g/m$^2$ and a basis weight between about 15 g/m$^2$ and 85 g/m$^2$. The cleaning sheets can be provided in stacked form and maintained within a sealed container wherein liquid is retained within the individual sheets as well as throughout the stack over time. The sheets can subsequently be removed from the container and applied to a surface wherein a high percent of the liquid is released from the sheet onto the surface in the initial pass and thereby allowing for improved treatment and/or cleaning of the surface.

22 Claims, 3 Drawing Sheets

Liquid Retention in a Stack

DURABLE HIGH FLUID RELEASE WIPERS

This application claims priority from U.S. Provisional Application No. 60/125,808 filed on Mar. 23, 1999, in the name of Keck et al.

TECHNICAL FIELD

The present invention relates to wipers and more particularly relates to fluid delivery products comprising nonwoven webs.

BACKGROUND OF THE INVENTION

Saturated or pre-moistened paper and textile wipers have been used in a variety of wiping and polishing cloths. These substrates are often provided in a sealed container and retrieved therefrom in a moist or saturated condition (i.e. pre-moistened). The pre-moistened cloth or paper wiper releases the retained liquid when used to clean or polish the desired surface. In addition, meltblown fiber fabrics have also been used as pre-moistened wipers in various applications and end uses. It is known that meltblown fiber fabrics are capable of receiving and retaining liquids for extended periods of time. More particularly, meltblown fiber fabrics are capable of being supplied in a stacked or rolled form wherein, when saturated with a liquid, the meltblown fiber fabrics maintain the liquid uniformly distributed throughout the stack. Thus, meltblown fiber sheets can be stacked in a sealable container and liquid added thereto. The sealed container can then be stored or shipped as needed and the stacked meltblown fabric retains the liquid evenly throughout the stack during the shelf life of the product. Uniformly moist meltblown fiber fabrics provided in a stacked form are described in U.S. Pat. Nos. 4,853,281 and 4,833,033 both to Win et al. Pre-moistened meltblown fiber fabrics have found a wide variety of applications including use as polishing clothes, hand wipes, hard surface cleaners and so forth. By way of example, various application s of pre-saturated meltblown fabrics are described in U.S. Pat. No. 5,656,361 to Vogt et a U.S. Pat. No. 5,595,786 to McBride et al. and U.S. Pat. No. 5,683,971 to Rose et al.

While meltblown fabrics provide desirable liquid absorption and retention characteristics, meltblown fabrics also provide a metered release of the liquid retained therein. Thus, in use it is often difficult to achieve a quick and substantial release of the liquid from the meltblown. In addition, in certain cleaning operations, meltblown fabrics can experience linting, i.e. the shedding of fibers from the fabric. This is particularly problematic in "clean room" operations or paint preparation procedures where production of even small particles such as lint is highly undesirable. In addition to linting, tearing or disassociation of the meltblown fabric can also be problematic when used for "heavy-duty" applications such as, for example, when cleaning rough and irregular surfaces. Multilayer laminates comprising spunbond fiber nonwoven webs and meltblown fiber fabrics have been previously utilized in order to provide a wiper that exhibits less linting and improved durability. However, although meltblown fabrics exhibit good liquid absorption and retention characteristics, these characteristics have not heretofore been readily achievable with spunbond fiber nonwoven webs. Thus, the meltblown fiber webs provide such laminates with good liquid retention characteristics and the outer spunbond fabric provide reduced linting. As an example U.S. Pat. No. 4,436,780 to Hotchkiss et al. describes a spunbond/meltblown/spunbond laminate having a relatively high basis weight meltblown layer between two spunbond fiber layers.

Thus, there exists a continued need for a uniformly moist wiper and uniformly moist stacked pre-moistened products thereof, which exhibit improved tear strength and durability. Furthermore, there exists a need for such a wiper and articles thereof which exhibit reduced linting. Still further, there exists a need for such a %Wiper that exhibits a high initial and substantial release of liquid contained therein.

SUMMARY OF THE INVENTION

The aforesaid needs are fulfilled and the problems experienced by those skilled in the art overcome by the wipers or cleaning sheets of the present invention which comprise a spunbond fiber web having an average fiber size less than about 18$\mu$ and a basis weight between about 15 g/m$^2$ and about 85 g/m$^2$. In addition, the sheets desirably provide a substrate that retains the liquid over time and yet has initial liquid release of at least about 17%. Further, the fine spunbond fiber web desirably has a normalized tensile strength greater than 0.13-kg per gram per square meter. Still further, the fine fiber spunbond nonwoven web desirably has a mean pore size of less than about 35 micrometers and a Taber resistance of at least 50 cycles.

In a further aspect of the invention, the fine fiber spunbond wipes can be utilized to provide a cleaning system such as a pre-packaged stack of wet spunbond wipes having excellent liquid retention in the stack and yet which provide high liquid release in use. In this regard a wiping product can comprise a sealable container having a liquid and a plurality of stacked fine fiber spunbond wipes as described herein. The fine fiber spunbond fiber nonwoven web Within the container desirably has a substantially uniform liquid retention after thirty days wherein there is no substantial liquid migration within the stack towards the bottom of the container and the upper and lower portions of the stack retain a substantially equivalent amount of liquid. The stack desirably has a height of less than about 21 centimeters and comprises at least about 10 layers. The sheets can be folded, perforated or otherwise processed to provide a readily accessible wipe having the desired size and shape. The pre-moistened sheets can be removed from the container and applied to a surface to be treated such as, for example, by hand. Fluid is readily released from the sheet onto the surface thereby enhancing the treatment of the surface and/or the cleaning action of the fine fiber spun bond sheet.

FIG, 3 is a partially side view of a container and pre-moistened Wipes.

Figure 3:
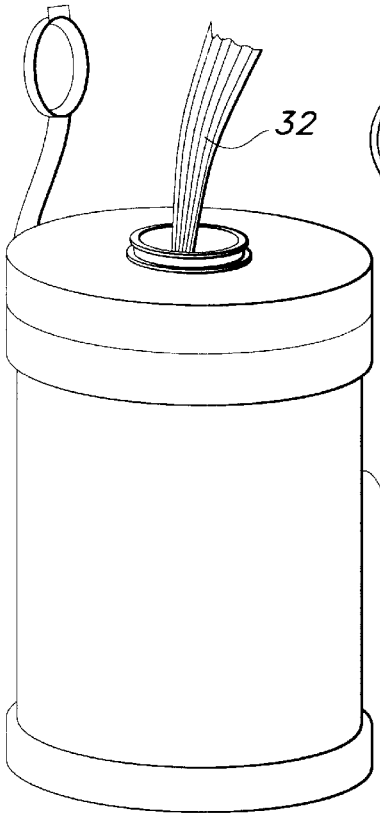
Figure 3A:
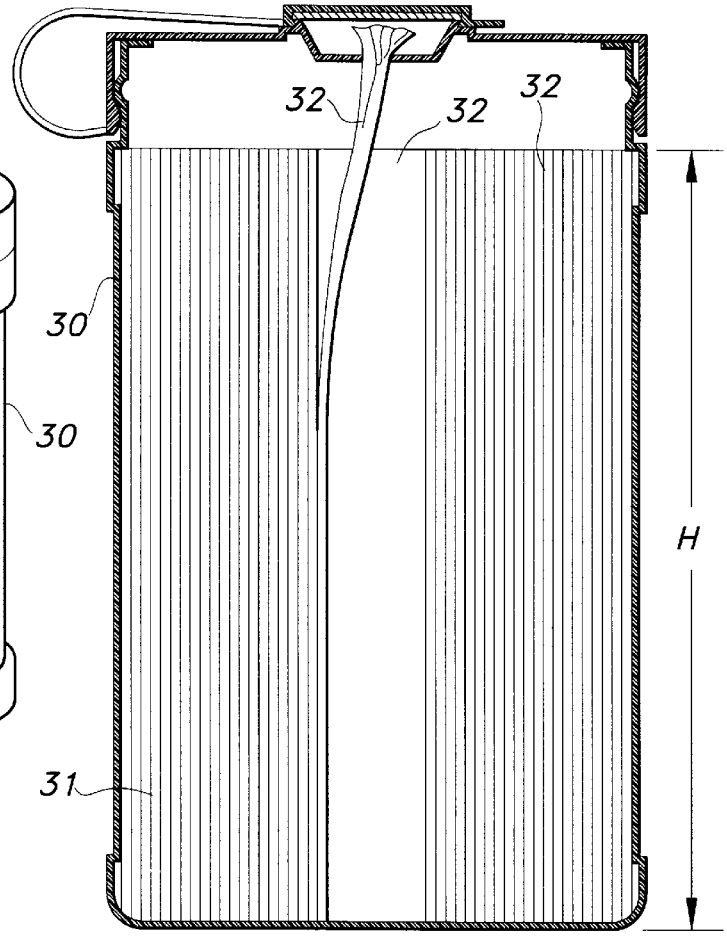

FIG. 3A is a cross-sectional view of the container and wipes of FIG. 3.

Figure 4:
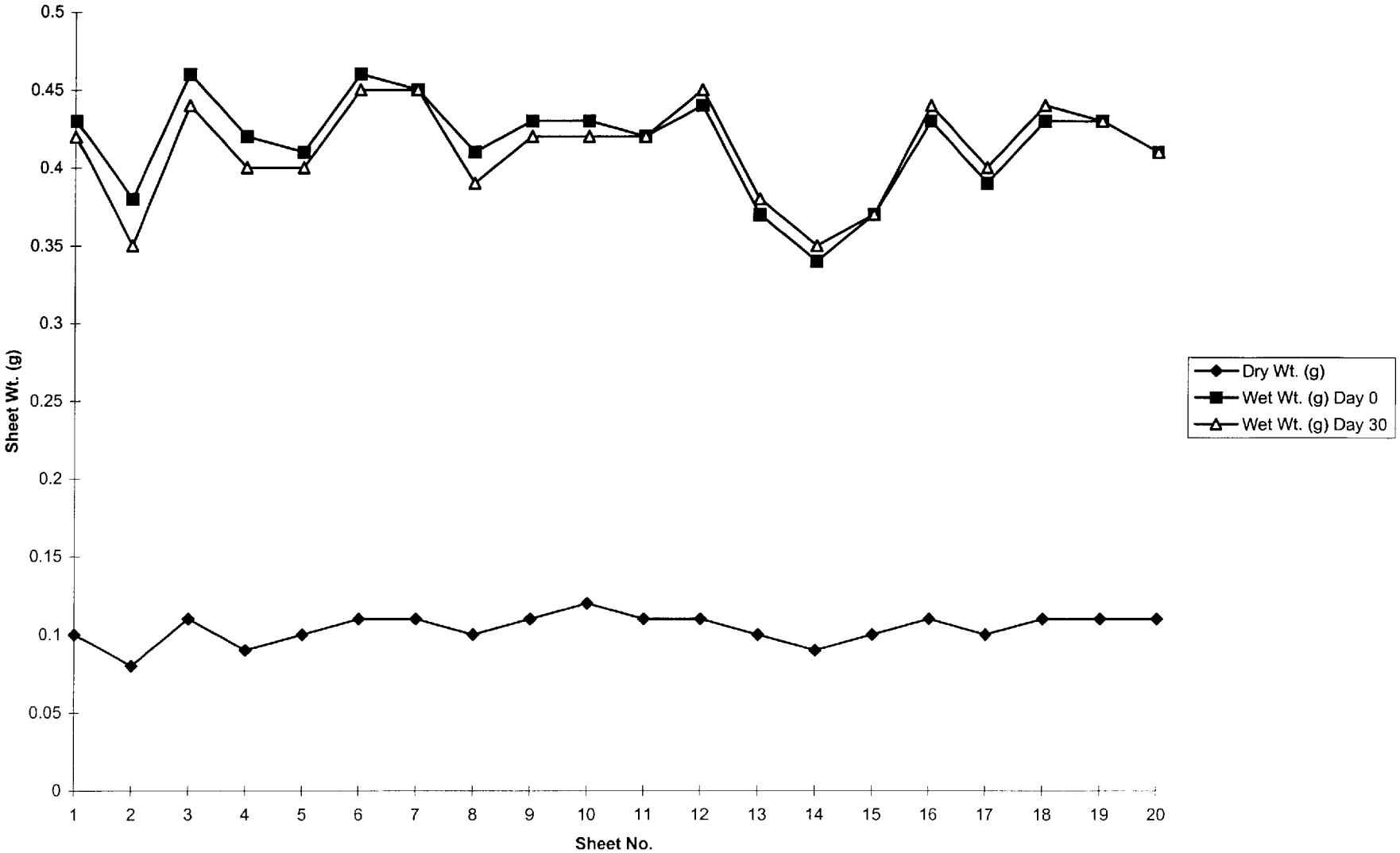

FIG. 4 is a graph plotting wet sheet weight per sheet over time.

DESCRIPTION OF THE INVENTION

Figure 1:
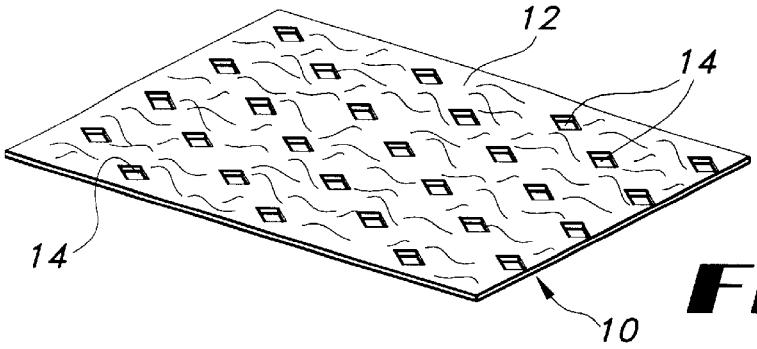
FIG. 1 is a partially elevated perspective view of a point bonded fine fiber spunbond wiper.

In reference to FIG. 1, wiper 10 of the present invention can comprise a section of a nonwoven web of fine spunbond fibers 12. The spunbond fibers have an average fiber diameter of about 17 micrometers or less and more desirably have an average fiber diameter between about 5 and 15 micrometers and still more desirably have an average fiber diameter between about 8 and 14 micrometers. As used herein the term "fiber diameter" refers to the largest cross-sectional dimension of the fiber. Desirably the spunbond fiber webs have a basis weight of between about 17 g/m$^2$ and about 85 g/m$^2$ and more desirably between about 25 g/m$^2$ and about 68 g/m$^2$. The spunbond fiber webs desirably have a mean pore size of less than about 35 micrometers and still more desirably a mean pore size between about 15 micrometers and about 30 micrometers. In a further aspect, the fine fiber spunbond webs desirably have an initial liquid release of about 17% and more desirably an initial liquid release above 20% and still more desirably an initial liquid release above 25%. In addition, the fine fiber spunbond wipes desirably release at least about 50% of the liquid therein within 5 passes and more desirably release at least about 50% of the liquid therein within 3 passes.

Fine spunbond fibers suitable for use with the present invention can include monocomponent, multicomponent and/or biconstituent fibers. In addition, although spunbond fibers are typically round, fibers having various geometric or irregular shapes can also be used in connection with the present invention. Spunbond fiber webs are known in the art and can be made by various processes such as those described in U.S. Pat. No. 4,692,618 to Dorschner et al., U.S. Pat. No. 4,340,563 to Appel et al., U.S. Pat. 3,802,817 to Matsuki et al., and U.S. Pat. Nos. 3,338,992 and 3,341,394 to Kinney, U.S. Pat. No. 3,502,763 to Hartman and U.S. Pat. No. 5,382,400 to Pike et al., the entire contents of each of the aforesaid references are incorporated herein by reference. However, spunbond fiber webs commonly comprise fibers having an average fiber size of about 20 micrometers or more. In this regard, it is possible to achieve fine fiber spunbond webs, having an average fiber size less than 18 micrometers, using traditional spunbond forming equipment by utilizing high melt flow rate resins such as those described in U.S. Pat. No. 5,681,646 to Ofosu et al. or post treatment of the fibers and/or nonwoven webs such as described in U.S. Pat. No. 5,244,482 to Hassenboehler, Jr. et al. and U.S. Pat. No. 5,759,926 to Pike et al., the entire contents of each of the aforesaid references are incorporated herein by reference. High melt flow rate (MFR) polymers, for the purposes of making spunbond fibers, include polymers having an MFR of at least about 35 and desirably an MFR between about 45 and about 200. The fine fiber spunbond web can comprise polyolefin, polyester, polyamide (e.g. nylon) or other polymers suitable for forming spunbond fibers. Desirably the fine fiber spunbond comprises a polyolefin and in a particularly preferred embodiment the fine spunbond fibers comprise a propylene polymer.

The production of high MFR polyolefins can be achieved by various methods. As an example, high MFR polyolefins may be achieved when starting with a conventional low melt flow polyolefin through the action of free radicals which degrade the polymer to increase melt flow rate. Such free radicals can be created and/or rendered more stable through the use of a prodegradant such as peroxide, an organometallic compound or a transition metal oxide. Depending on the prodegradent chosen, stabilizers may be useful. One example of a way to make a high melt flow polyolefin from a conventional low melt flow polyolefin is to incorporate a peroxide into the polymer. Peroxide addition to polymers is taught in U.S. Pat. No. 5,213,881 to Timmons et al. and peroxide addition to polymer pellets is described in U.S. Pat. No. 4,451,589 to Morman et al., the entire contents of the aforesaid references are incorporated herein by reference. Peroxide addition to a polymer for spunbonding applications can be done by adding up to 1000 ppm of peroxide to commercially available low melt flow rate polyolefin polymer and mixing thoroughly. The resulting modified polymer will have a melt flow rate of approximately two to three times that of the starting polymer, depending upon the rate of peroxide addition and mixing time. In addition, suitable high MFR polymers can comprise polymers having a narrow molecular weight distribution and low polydispersity (relative to conventional olefin polymers such as those made by Ziegler-Natta catalysts) and include those catalyzed by "metallocene catalysts", "single-site catalysts", "constrained geometry catalysts" and/or other like catalysts. Examples of such catalysts and/or polyolefins made therefrom are described in, but not limited to, U.S. Pat. No. 5,153,157 to Canich, U.S. Pat. No. 5,064,802 to Stevens et al., U.S. Pat. 5,374,696 to Rosen et al. U.S. Pat. No. 5,451,450 to Elderly et al.; U.S. Pat. No. 5,204,429 to Kaminsky et al; U.S. Pat. No. 5,539,124 to Etherton et al., U.S. Pat. Nos. 5,278,272 and 5,272,236, both to Lai et al., U.S. Pat. No. 5,554,775 to Krishnamurti et al. and U.S. Pat. No. 5,539,124 to Etherton et al. Exemplary polymers have a melt flow rate of about 35 or higher and, as a particular example, can have an MFR of about 50. In addition, polymers formed by such catalysts desirably have a narrow molecular weight distribution having a polydispersity number of about 2.5 or less and even more desirably of about 2. Exemplary commercially available polymers having a high melt flow rate, narrow molecular weight distribution and low polydispersity are available from Exxon Chemical Company under the trade name ACHIEVE.

The layer of formed spunbond fibers is bonded to provide a durable, coherent nonwoven web. By way of example only, the nonwoven web can be thermally, ultrasonically, adhesively and/or mechanically bonded. The fine spunbond fiber web is desirably pattern bonded. As an example and with reference to FIG. 1, the spunbond fiber sheet 10 can be point bonded to provide a fabric having numerous small, discrete bond points 14. An exemplary bonding process is thermal point bonding and this process generally involves passing one or more layers to be bonded between heated rolls such as, for example an engraved patterned roll and a second bonding roll. The engraved roll is patterned in some way so that the fabric is not bonded over its entire surface, and the second roll can be smooth or patterned. As a result, various patterns for engraved rolls have been developed for functional as well as aesthetic reasons. Exemplary bond patterns include, but are not limited to, those described in U.S. Pat. 3,855,046 to Hansen et al., U.S. Pat. No. 5,620,779 to Levy et al., U.S. Pat. No. 5,962,112 to Haynes et al., and U.S. Design Patent No. 390,708 to Brown. In addition, the fine spunbond fiber sheet can be bonded by continuous seams or patterns. As particular examples, the spunbond fiber sheet can be bonded along the periphery of the sheet or simply across the width or cross-direction (CD) of the fabric adjacent the edges. Desirably the bond areas comprise between about 5% and about 30% of the surface area of the fabric and more desirably comprise between about 10% and about 20% of the total surface area of the fabric and still more desirably between about 12% and about 17% of the total surface area of the fabric. The bonded fine fiber spunbond webs desirably have a Taber Resistance of at least about 50 cycles and still more desirably a Taber Resistance of about 65 cycles or more. In a further aspect, the fine spunbond fiber webs desirably have a machine direction tensile strength of at least about 140-g per g/m$^2$ and more desirably have a tensile strength in excess of about 180-g per g/m$^2$ and still more desirably a tensile strength in excess of about 210-g per g/m$^2$. As an example, a 51-g/m$^2$ nonwoven web of a polypropylene fine fiber spunbond desirably has a tensile strength in excess of about 7-kg and more desirably a tensile strength in excess of about 9-kg and still more desirably a tensile strength of at least about 10-kg.

The spunbond fiber sheet can be apertured or have various surface projections to vary the tactile attributes of the fine spunbond fiber sheet. Additionally, one or more of the surfaces of the fine fiber spunbond sheet can be rendered abrasive by addition of particulate matter to the sheet. Still further, one or more surfaces of the sheet may be rendered abrasive and/or provide a coarse surface layer by forming a layer of macrofibers on the fine fiber spunbond sheet. Desirably the macrofibers have an average fiber diameter of about 25 micrometers or more and can comprise spunbond or meltblown fibers. As an example, the macrofibers can comprise fibers having a diameter of about 40 micrometers or more and may be formed as described in U.S. Pat. No. 4,659,609 to Lamers et al; the entire contents of which are incorporated herein by reference. The abrasive layer desirably has little or no liquid retention properties and has a basis weight less than about 15 g/m$^2$ and still more desirably has a basis weight of about 10 g/m$^2$ or less.

Stacked fine fiber spunbond nonwoven webs can be pre-moistened and/or saturated with liquid and are desirably capable of substantially uniformly retaining the liquid over extended periods of time. Thus, stacked fine fiber spunbond nonwoven webs can be pre-moistened and then stored in a sealed container until needed. This is particularly advantageous in that wipers taken from the top of a stack will contain substantially the same amount of liquid as those taken later and/or from the bottom of the stack. Although spunbond fiber nonwoven fabrics have been used in various wiping or cleaning applications heretofore, spunbond fiber nonwoven webs have not provided a substrate capable of substantially uniformly retaining liquid in a stack over time. This has previously been achievable only with meltblown fiber webs or composite fabrics employing the same. However, the stacked fine fiber spunbond fabric maintains a substantially uniform liquid distribution for at least 30 days. In this regard the stack experiences insubstantial liquid migration over time and, in particular, avoids migration wherein the upper portion of the stack contains significantly less liquid relative to the amount of liquid within the lower portion of the stack. Thus, the sealed container houses the pre-moistened fine fiber spunbond nonwoven fabric and the stacked sheets experience insubstantial liquid migration during storage and/or shipping of the product. The average weight % liquid within the sheets desirably varies by less than about 10% over 30 days and more desirably varies by less than about 7% over 30 days and even more desirably varies by less than about 5% over 30 days and still more desirably varies by less than about 3% over 30 days.

As used herein, the term "stack" is used broadly to include any collection of spunbond fiber sheets wherein there is a plurality of surface-to-surface interfaces. This not only includes a vertically stacked collection of individual sheets, but also includes a horizontally stacked collection of individual sheets as well as a rolled or folded collection of continuous sheet material. In the case of a horizontal stack in accordance with this invention, where the individual sheets are standing on edge, the liquid concentration will be maintained substantially equal from the top to the bottom of each individual sheet, as well as from sheet to sheet. A rolled or folded product comprising a continuous sheet desirably has perforated or overbonded lines of weakness which allow separation into smaller individual sheets of a desired shape and size. Notably, when wound into a roll, the concentration of liquid within the roll of fine fiber spunbond equilibrates to substantially equal concentrations, regardless of the orientation of the roll within a container.

Figure 2:
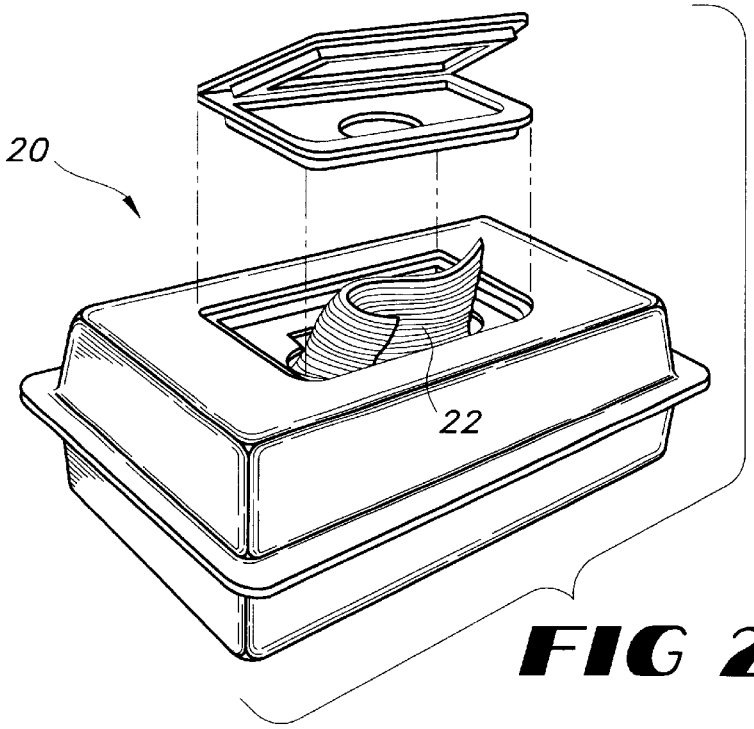
FIG. 2 is a perspective view of a sealable container and wipes.
Figure 2A:
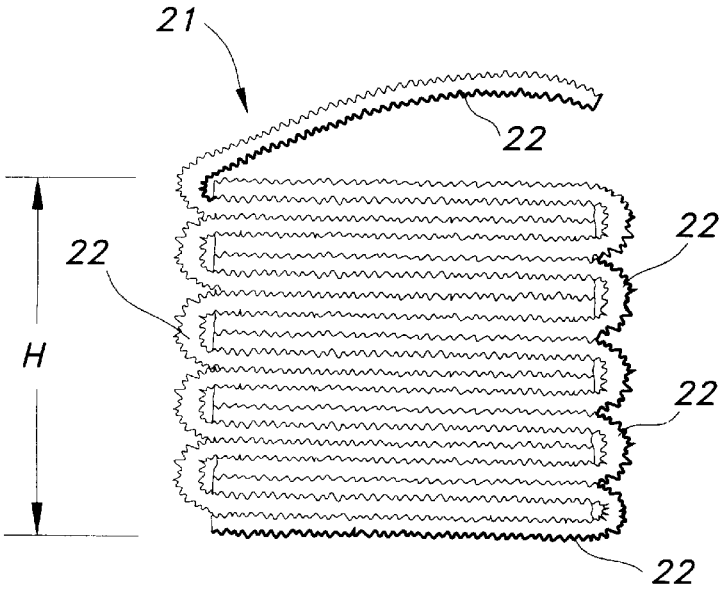
FIG. 2A is a exposed side view of the stacked wipes of FIG. 2.

The stack desirably has at least about 10 layers and more desirably has between about 10 and about 250 layers and still more desirably between about 20 and about 200 layers As used herein layers refer to the number of fabric interfaces. In this regard, a rolled sheet will be considered to have a fabric interface or "layer" for each revolution. Further, a sheet folded one or more times will likewise create additional fabric interfaces or layers; as an example, 20 individual superposed sheets in half folds (e.g. folded in half) create 39 layers. The stack desirably has a height less than about 21 cm and still more desirably has a height between about 12 cm and about 20 cm. With reference to FIGS. 2 and 2A, the stack height (H) is the height of the superposed sheets 22 within the container 20. With regard to FIGS. 3 and 3A and the rolled wipes depicted therein, the stack 31 has a height (H) corresponding with the role height or width of the continuous sheet material 32 within the container 30.

The wet, stacked fine fiber spunbond fiber sheets can be maintained over time in a sealable container such as, for example, within a bucket with an attachable lid, sealable plastic pouches or bags, canisters, jars, tubs and so forth. Desirably the wet, stacked spunbond fiber sheets are maintained in a resealable container. The use of a resealable container is particularly desirable when using highly volatile liquid compositions since substantial amounts of liquid can evaporate while using the first sheets thereby leaving the remaining sheets with little or no liquid. Exemplary resealable containers and dispensers include, but are not limited to, those described in U.S. Pat. No. 4,171,047 to Doyle et al., U.S. Pat. No. 4,353,480 to McFadyen, U.S. Pat. 4,778,048 to Kaspar et al., U.S. Pat. No. 4,741,944 to Jackson et al., U.S. Pat. No. 5,595,786 to McBride et al.; the entire contents of the aforesaid references are incorporated herein by reference. The fine spunbond fiber sheets can be incorporated or oriented in the container as desired and/or folded as desired in order to improve efficiency of use as is known in the art.

A selected amount of liquid is added to the container such that the fine spunbond fiber wipes contain the desired amount of liquid. Typically, the stacked sheet material is placed or formed in the container and the liquid subsequently added thereto. The fine spunbond fiber wipe can subsequently be used to wipe a surface and/or act as a vehicle to deliver and apply liquid to a surface. The moistened and/or saturated fine fiber spunbond wipes can be used to treat various surfaces. As used herein "treating" surfaces is used in the broad sense and includes, but is not limited to, wiping, polishing, swabbing, cleaning, washing, disinfecting, scrubbing, scouring, sanitizing, and/or applying active agents thereto. As an example, fine fiber spunbond webs are well suited to treating hard surfaces such as, for example, counters, tables, furniture, workstations, windows, lab tops, equipment, machinery, floors, walls and so forth. Suitable hard surfaces include metal, glass, wood, stone, plastic, and so forth. In addition, the fine fiber nonwoven webs can be used to treat various other surfaces such as, for example, for treating skin. The fine fiber spunbond wipers are well suited for use as hand or facial wipes and are likewise well suited for use in various medical and/or veterinary applications as well. Notably, the fine fiber spunbond webs exhibit considerably less linting than meltblown fiber webs and thus may be better suited for use in connection with clean room applications and other uses in which contamination by lint is of considerable concern. Moreover, the improved tensile strength provides a more durable wiper better suited to more rigorous or "heavy-duty" cleaning operations. In addition, a high liquid release is highly desirably for many uses such as, for example, when disinfecting a surface. Often a surface needs ample disinfectant to thoroughly wet the surface as well as allow the surface to remain wet for a sufficient period of time in order for the disinfectant to be efficacious.

The amount and composition of the liquid added to the fine fiber spunbond will vary with the desired application and/or function of the wipes. As used herein the term "liquid" includes, but is not limited to, solutions, emulsions, suspensions and so forth. Thus, liquids may comprise and/or contain one or more of the following: disinfectants; antiseptics; diluents; surfactants, such as nonionic, anionic, cationic, and amphoteric surfactants; emollients; skin conditioners; antimicrobial agents; sterilants; sporicides; germicides; bactericides; fungicides; virucides; protozoacides; algicides; bacteriostats; fungistats; virustats; sanitizers; antibiotics; pesticides; bug repellents and so forth. Often the liquid will comprise an aqueous solution or emulsion. As an example, aqueous alcoholic compositions are well suited for use with the fine spunbond fiber nonwoven webs. The term aqueous alcoholic composition encompasses any composition that contains both water and an alcohol. The alcohol desirably comprises a saturated aliphatic alcohol having from one to about six carbon atoms. By way of illustration only, the alcohol may be methanol, ethanol, propanol, isopropanol, butanol, t-butanol, 2-butanol, pentanol, 2-pentanol, hexanol, 2,3-dimethyl-1-butanol, and so forth, including mixtures of two or more alcohols. For example, the aqueous alcoholic composition may be an aqueous isopropanol composition. As a particular example, the aqueous alcoholic composition may comprise from about 20% to about 99% percent by volume alcohol and from about 1% to about 80% by volume water. Still more desirably, the aqueous alcohol composition can comprise between about 65% to 95% by volume alcohol and from about 35% to about 5% by volume water. As a specific example, the alcoholic composition can comprise about 85% isopropyl alcohol and about 15% deionized water. As a further specific example, the aqueous alcohol composition can comprise a liquid suitable for external disinfecting of skin and other surfaces and can comprise about 29.5% deionized water, about 70% isopropyl alcohol and about 0.5% benzalkonium chloride.

Optionally, it is possible to add a surfactant to the liquid within the stacked sheets and/or apply a surfactant or wetting agent to the fine spunbond fibers themselves prior to addition of the liquid thereto. The surfactants or wetting agents can be applied topically to the spunbond fibers or internally prior to extrusion. By way of example only, wetting agents and methods of applying the same to nonwovens are described in U.S. Pat. No. 3,973,068 to Weber et al.; U.S. Pat. No. 4,328,279 to Meitner et al; U.S. Pat. No. 4,923,914 to Nohr et al. U.S. Pat. No. 4,578,414 to Sawyer et al.; U.S. Pat. No. 4,920,168 to Nohr et al.; U.S. Pat. No. 5,656,191 to Nohr et al. and U.S. Pat. No. 5,814,567 to Yahiaoui et al.; the entire contents of the aforesaid patents are incorporated herein by reference. As used herein the term "wetting agent" refers to any chemical compound or composition that makes a fiber surface exhibit increased hydrophilic characteristics.

Tests

Tensile Strength: Tensile strength or peak load measures the maximum load (gram force) before the specimen ruptures. A 10.2-cm by 15.2-cm sample is placed in a 2.5-cm by 2.5-cm rubber coated clamp and a 2.5-cm by 5.1-cm rubber coated clamp (with the longer dimension being perpendicular to the load) so that the machine direction (i.e. the direction in which the fabric is made) is parallel with the load. The sample is placed in the clamps such that there is a 7.6-cm gage length. The test can be performed with an 1130 Instron Tensile Tester (available from Instron Corporation of Canton, Mass.) and utilizes a crosshead speed of 30.5 cm/minute and a 4.5-kg load cell. The load at rupture is reported in grams. The normalized tensile strength is calculated by dividing the tensile strength by the basis weight (in grams per square meter) and is reported in $g/g/m^2$.

Melt Flow Rate: Melt flow rate (MFR) determines the amount of polymer that flows through an opening at a set temperature and pressure and is reported in grams polymer per 10 minutes. Melt flow rate (MFR) can be determined before the polymer is melt-processed in accord with ASTM D1238-90b; the specific test conditions (i.e. temperature) will vary with the particular polymer as described in the aforesaid test.

Test conditions for polypropylene are 230° C.

Percent Liquid Release: Percent liquid release measures the amount of liquid a sheet releases under a specified load and approximates actual wiping conditions. A 7.6-cm by 17.8-cm sample is cut and the dry weight measured. The sample is attached to an aluminum block having a mass of 0.45-kg. The sample/block assembly is then weighted. Seventy-five percent (75%) of the samples liquid capacity is added directly to the fabric, allowed to distribute throughout the sample for 1 minute and the sample/block assembly is again weighed. The total grams liquid added to the sample is obtained by the difference of the dry weight of the sample/block assembly and the wet weight of the sample/block assembly. The sample/block assembly is then pulled 142-cm (distance) along a smooth, dry bench top (with the fabric facing the bench top). The sample/block assembly is again weighed. The bench top is dried and the sample/block assembly pulled across the surface a second time and the sample/block assembly is again weighed and recorded. Additional passes across a dry bench top are performed until the fabric dries out or shows no further change. The amount of liquid released for each pass is obtained by the difference of the weight of the sample/block assembly prior to the pass and the weight of the sample/block assembly after the pass. The percent of liquid released for each pass can be calculated as follows: % Liquid Release= (grams liquid released÷total grams liquid)×100. The initial liquid release is that released on the first pass.

Taber Abrasion resistance: Taber Abrasion resistance measures the abrasion resistance in terms of destruction of the fabric produced by a controlled, rotary rubbing action. Abrasion resistance measurements can be measured in accord with Method 5306, Federal Test Methods Standard No. 191A, except as otherwise noted herein. Only a single wheel is used to abrade the specimen. A 12.7×12.7-cm specimen is clamped to the specimen platform of a Taber Standard Abrader (Model No. 504 with Model No. E-140-15 specimen holder) having a rubber wheel (No. H-18) on the abrading head and a 500-gram counterweight on each arm. The loss in breaking strength is not used as the criteria for determining abrasion resistance. The results are obtained and reported in abrasion cycles to failure where failure is deemed to occur at that point where a 1.25-cm hole is produced within the fabric.

Mean Pore Size: Mean pore size can be determined using a PMI Automated Capillary Flow Porometer (Model CFP1100ATXLH).

EXAMPLE

Example 1

A spunbond fiber web is produced in accord with known spunbond processes such as those described in U.S. Pat. No. 3,802,817 to Matsuki et al. using a high MFR polypropylene polymer (available from Exxon Chemical Co. under the trade name ACHIEVE and designation Exxon-3915, having an MFR of 50 and a polydispersity number of 2). The fine fiber spunbond web had an average fiber size of about 11 microns. The fine spunbond fibers were point bonded with a bond area of approximately 17% of the surface area of the fabric. Twenty circular sheets having a 5-cm diameter were cut from the bonded spunbond fiber web, weighed and then superposed with one another (unfolded) to form a stack. Approximately 6.6-g liquid (75% capacity of the stack sheets) was added to the stack and allowed to equilibrate throughout the stack. The liquid comprised 99% by volume water and 1% by volume surfactant (sodium dioctyl sulfosuccinate). The individual sheets were removed from the stack and the wet weight recorded. The sheets were returned to the stack and then the container sealed and stored at room temperature for 30 days. After being stored for 30 days, the wet weight of the sheets was obtained (correction is made for liquid left on the scale in the prior weighing). The dry sheet weight, wet sheet weight at zero days and wet sheet weight at 30 days is plotted in the graph of FIG. 4. The graph evidences that the fine spunbond fiber sheets experience little liquid migration over time and provide a uniformly moist stack of pre-moistened wipers.

While various patents and other reference materials have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover or encompass all such modifications, alterations and/or changes. Furthermore, as used herein, the term "comprises" or "comprising" is inclusive or open-ended and does not exclude additional unrecited elements, compositional components, or method steps. Accordingly, the term "comprising" encompasses the more restrictive terms "consisting essentially of" and "consisting of."

We claim:

1. A liquid delivery system comprising:

a sealable container;

stacked sheets having at least 10 layers, said sheets comprising spunbond fiber nonwoven webs having a basis weight of at least about 15 g/m$^2$, a Taber abrasion resistance of at least 50 cycles and a tensile strength greater than 0.13 kg per gram per square meter, and wherein said spunbond fibers have an average fiber diameter less than 18 micrometers; and liquid substantially uniformly distributed throughout said stacked sheets and wherein said sheets have an initial liquid release of at least about 17%.

2. The liquid delivery system of claim 1 wherein said sheets comprise a pattern bonded nonwoven web of spunbond fibers.

3. The liquid delivery system of claim 1 wherein said sheets comprise a point bonded nonwoven web of spunbond fibers and wherein the bond area comprises between about 5% and about 30% of the surface area of said sheets.

4. The liquid delivery system of claim 3 wherein said sheets have an initial liquid release of at least 20%.

5. The liquid delivery system of claim 4 wherein said spunbond fibers comprise a propylene polymer and wherein said sheets have a basis weight between 15 g/m$^2$ and 85 g/m$^2$.

6. The liquid delivery system of claim 5 wherein said spunbond fibers have a Taber resistance of at least 65 cycles and a tensile strength of at least 0.21-kg per gram per square meter.

7. The liquid delivery system of claim 1 wherein said sheets contain a wetting agent.

8. The liquid delivery system of claim 1 wherein said spunbond fibers comprise a polyolefin polymer.

9. The liquid delivery system of claim 1 wherein said spunbond fibers comprise a propylene polymer.

10. The liquid delivery system of claim 9 wherein said stack has a height less than 21 cm.

11. The liquid delivery system of claim 10 wherein said sheets have a coarse fiber layer upon the outer surface of at least one side of said sheet.

12. The liquid delivery system of claim 1 wherein said spunbond fiber webs comprise fibers having an average fiber diameter between about 8 and 15 micrometers and a mean pore size between about 15 and about 35 micrometers.

13. The liquid delivery system of claim 1 wherein said sheets comprise a pattern bonded web of propylene polymer spunbond fibers having a basis weight between about 15 g/m$^2$ and 85 g/m$^2$.

14. The liquid delivery system of claim 13 wherein said sheets have a tensile strength greater than 0.18-kg gram per square meter.

15. The liquid delivery system of claim 14 wherein said sheets contain a wetting agent.

16. The liquid delivery system of claim 14 wherein said sheets have an initial liquid release greater than 20%.

17. The liquid delivery system of claim 16 wherein the spunbond fibers have an average fiber diameter between about 8 and 15 micrometers and a mean pore size between about 15 and about 35 micrometers.

18. The liquid delivery system of claim 1 wherein the average weight % liquid within the sheets varies by less than about 7% over 30 days.

19. The liquid delivery system of claim 1 wherein the average weight % liquid within the sheets varies by less than about 3% over 30 days.

20. A liquid delivery system comprising:

a sealable container;

stacked sheets having a stack height less than 21 cm and at least 10 layers, said sheets consisting essentially of a bonded spunbond fiber nonwoven web wherein said spunbond fibers have an average fiber diameter less than 18 micrometers and wherein said sheets have a basis weight of at least about 15 g/m$^2$, a Taber abrasion resistance of at least 50 cycles and a tensile strength greater than 0.13 kg per gram per square meter;

a liquid substantially uniformly distributed throughout said stacked sheets and wherein said sheets have an initial liquid release of at least about 17%.

21. The liquid delivery system of claim 20 wherein the average weight % liquid within the sheets varies by less than about 7% over 30 days.

22. The liquid delivery system of claim 20 wherein the average weight % liquid within the sheets varies by less than about 3% over 30 days.

* * * * *